United States Patent [19]

Thesing et al.

[11] Patent Number: 5,012,829

[45] Date of Patent: May 7, 1991

[54] FLAVORED CIGARETTE FILTERS, AND METHODS AND APPARATUS FOR MAKING SAME

[75] Inventors: Richard A. Thesing; Walter A. Nichols, both of Richmond, Va.

[73] Assignee: Philip Morris Incorporated, Richmond, Va.

[21] Appl. No.: 138,584

[22] Filed: Dec. 28, 1987

Related U.S. Application Data

[63] Continuation-in-part of Ser. No. 799,750, Nov. 19, 1985, Pat. No. 4,715,390.

[51] Int. Cl.[5] ..... A24D 3/04; A24D 3/02

[52] U.S. Cl. ..... 131/344; 131/335; 131/340; 493/39; 493/42; 493/47; 493/49

[58] Field of Search ..... 131/344, 335, 340; 493/39, 47, 50, 42, 49

[56] References Cited

U.S. PATENT DOCUMENTS 4,026,306 5/1977 Berger .
4,046,063 9/1977 Berger .
4,064,791 12/1977 Berger .
4,355,995 10/1982 Berger .

*Primary Examiner*—V. Millin
*Attorney, Agent, or Firm*—Robert R. Jackson

[57] ABSTRACT

A cigarette filter has a substantially cylindrical inner member of filter material surrounded by an outer member of filter material and a plugwrap. The density of the inner and outer members are typically different, and a flavorant is added to at least one of the members. Methods and apparatus for making the filter are also disclosed.

19 Claims, 5 Drawing Sheets

FIG. 1
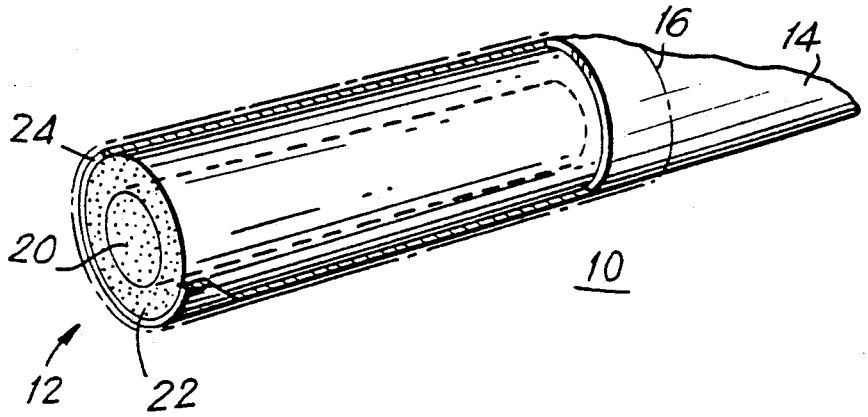
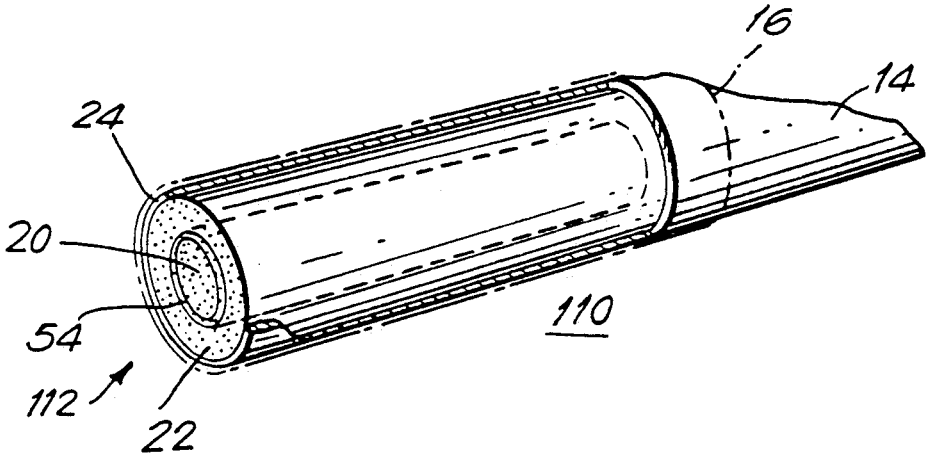
FIG. 6

FLAVORED CIGARETTE FILTERS, AND METHODS AND APPARATUS FOR MAKING SAME

This application is a continuation-in-part of U.S. patent application Ser. No. 799,750 filed Nov. 19, 1985, now U.S. Pat. No. 4,715,390 which is hereby incorporated by reference herein.

BACKGROUND OF THE INVENTION

This invention relates to filters for cigarettes and other smoking articles, and more particularly to cigarette filters having multiple components which are selectively flavored and/or have various cigarette smoke flow characteristics. The invention also relates to methods and apparatus for making the foregoing filters.

Cigarette filters having two or more concentric filter components may have certain advantages. For example, they may facilitate the production of cigarettes which satisfy several competing criteria with respect to such factors as filter efficiency, taste, firmness, smoke stream distribution, dilution, etc. Prior art techniques for producing such filters have, however, relied heavily on heat (and especially steam) to partially fuse and thereby stabilize each filter component as it is formed (see, for example, Berger U.S. Pat. Nos. 4,026,306; 4,046,063; 4,064,791; and 4,355,995, all of which are hereby incorporated by reference herein). Many desirable flavor additives are sensitive to heat and/or moisture. It is therefore difficult or impossible to add such flavorants to prior art composite filters. For example, commonly assigned, co-pending U.S. patent application Ser. No. 799,750, filed Nov. 19, 1985 (hereby incorporated by reference herein), discloses flavorant compositions (hereinafter generically referred to collectively as "PVA-flavorants", individually as "PVA-flavorant", or (where the flavor is menthol) as "PVA-menthol") which are activated to release their flavor by the addition of moisture. (The letters "PVA" are used in the foregoing terms merely to identify the referenced flavorants as being any of those disclosed in application Ser. No. 799,750, and not to imply that the referenced flavorants necessarily include polyvinylacetate, although the especially preferred PVA-flavorants do in fact include polyvinylacetate.) The intended source of activating moisture is the moisture in the tobacco smoke drawn through the filter when the cigarette is smoked. However, the steam used in making prior art composite filters also unavoidably activates previously applied PVA-flavorants to release their flavors, thereby increasing the difficulty of adding PVA-flavorants during the formation of composite filters (which is plainly an otherwise desirable time to add a flavorant to a filter).

In view of the foregoing, it is an object of this invention to provide improved composite cigarette filters.

It is another object of this invention to provide composite cigarette filters which can be more easily, successfully, and efficiently flavored, especially with PVA-flavorants.

It is yet another object of this invention to provide composite cigarette filters in which the various components have different flow characteristics and are selectively flavored to make more efficient use of the flavorant and/or to achieve various flavor objectives.

It is still another object of this invention to provide improved methods and apparatus for making composite cigarette filters, especially composite cigarette filters with the foregoing characteristics.

SUMMARY OF THE INVENTION

These and other objects of the invention are accomplished in accordance with the principles of the invention by providing a composite cigarette filter in which flavorant is added to at least one component of the filter, and thereafter only chemical plasticizers (such as triacetin) and/or wrapping (not heat or steam) are used to stabilize the filter. For example, if the filter comprises concentric inner and outer filter members, and it is desired to add flavor to the inner member, then the inner member is formed either by bunching together previously flavored strands or by adding flavor to the bunch after it has been formed, and then without heating or steaming the inner member (but possibly after wrapping the inner member with a plugwrap-type material) forming the outer member around the inner member. The outer member is then stabilized by plugwrap and without the use of either heat or steam. Thus heat and steam are completely avoided after the flavorant has been added to the filter being formed. If flavorant were to be added only to the outer member, heat or steam could be used to stabilize the inner member prior to addition of the outer member elements. But once the flavorant has been added to the structure, the subsequent use of heat or steam is entirely avoided.

Triacetin or other conventional plasticizers which do not adversely affect the flavorant may be used in the conventional manner to help form and stabilize the inner and/or outer members. Because triacetin is a constituent of all PVA-flavorants, application of these flavorants to either or both filter members not only imparts flavor to that member, but also helps stabilize it.

The flow characteristics of the filter components may be selected to achieve a wide range of filter objectives. For example, in a filter having concentric inner and outer members, the inner member can be flavored and provided with a low flow resistance while the outer member is left unflavored and provided with a high flow resistance. This will have a tendency to reduce the amount of flavorant required, to increase the efficiency with which the flavorant is used, and to deliver more flavor to the tongue and less to the lips. Other objectives can be achieved by employing other combinations of flavorant location and relative flow resistance.

Further features of the invention, its nature and various advantages will be more apparent from the accompanying drawings and the following detailed description of the invention.

BRIEF DESCRIPTION OF THE DRAWINGS

FIG. 1 is a partly sectional, partial, perspective view of a cigarette including a composite filter made in accordance with this invention.

FIG. 6 is a view similar to FIG. 1 showing the filter produced by the apparatus of FIG. 5.

DETAILED DESCRIPTION OF THE PREFERRED EMBODIMENTS

Figure 2:
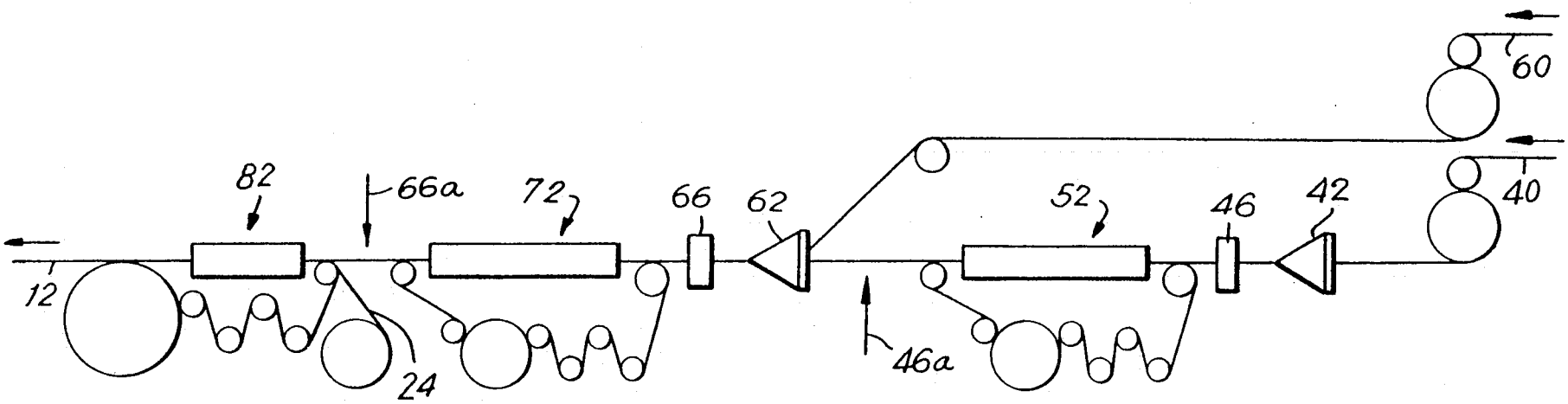
FIG. 2 is a simplified schematic diagram of apparatus constructed in accordance with this invention for making filters of the type shown in FIG. 1.

As shown in FIG. 1, a cigarette 10 including a typical composite filter 12 of this invention includes a tobacco rod 14 secured to filter 12 by tipping overwrap 16. Filter 12 includes inner member 20, outer member 22, and plugwrap 24, all of which are concentric with one another. Inner and outer members 20 and 22 may be made of any conventional filter material such as cellulose acetate. Plugwrap 24 is a conventional plugwrap material such as a porous paper. Tipping overwrap 16 may also be conventional and may be conventionally perforated to admit dilution air to the cigarette as is well known to those skilled in the art.

One or more conventional flavorants such as PVA-menthol or any other PVA-flavorant may be added to either or both of members 20 and 22. The cigarette smoke flow resistance of members 20 and 22 may either be substantially similar or very different. For example, the flow resistance of inner member 20 may be substantially lower than the flow resistance of outer member 22 so that most of the smoke flows through inner member 20 and only a relatively small fraction of the smoke flows through outer member 22. Alternatively, the flow resistance of inner member 20 may be substantially higher than the flow resistance of outer member 22 so that most of the smoke flows through outer member 22 and only a small fraction of the smoke flows through inner member 20.

In a particularly preferred embodiment, approximately 95% of the smoke flows through inner member 20. Inner member 20 has a pressure drop of about 2.0–3.0 inches of water per 27 mm of length, while outer member 22 has a pressure drop of 15 inches or more of water per 27 mm of length. PVA-menthol flavorant is added to inner member 20, while outer member 22 is left unflavored. This embodiment has a number of important advantages. For one thing, it concentrates the flavorant where the flow is greatest, thereby increasing the efficiency with which the flavorant is used and decreasing the amount of flavorant that is required. Another advantage of this embodiment is that it tends to direct the flow of menthol flavored smoke onto the smoker's tongue (where menthol flavor is most desired) and away from the lips (where it is less desired). Yet another advantage of this embodiment is that if tipping overwrap 16 is provided with holes to admit dilution air, that air tends to flow radially inwardly into inner member 20 where it mixes well with the smoke before entering the smoker's mouth. This is the most desirable use of dilution air. Still another advantage of this embodiment is that outer member 22 is quite firm (because it is so dense). This gives the filter as a whole a desirable firmness without the need for an extra-stiff plugwrap 24.

Although the foregoing embodiment is highly preferred, there may be other reasons for selecting other combinations of the parameters which characterize the components of the filter structure of this invention.

Illustrative apparatus for making filters like filter 12 is shown in FIG. 2. Conventional cellulose acetate tow 40 for inner member 20 is continuously supplied to conventional stuffer jet 42 which compresses the tow into a generally cylindrical rod having the desired transverse shape and dimensions and the desired density. If inner member 20 is to be flavored, flavorant (preferably either including a conventional chemical plasticizer such as triacetin (as in the case of PVA-flavorants) or accompanied by such a plasticizer) is applied by element 46 which may be any suitable apparatus such as a device for spraying flavorant onto the filter material, a felt ring wiping or wicking the flavorant onto the filter material, or a metal orifice through which the filter material passes while flavorant is forced into it through one or more holes extending radially outward from the main orifice. (Element 46 can either be omitted or supplied only with plasticizer if inner member 20 is not to be flavored.) The filter material exiting from elements 42 and 46 is pulled along by conventional garniture means 52.

The filter material exiting from garniture means 52 enters conventional stuffer jet 62 along with the conventional cellulose acetate tow 60 for outer member 22. Stuffer jet 62 forms tow 60 concentrically around the filter material from garniture means 52 and compresses tow 60 into a generally cylindrical rod having the desired transverse shape and dimensions and the desired density. If outer member 22 is to be flavored, flavorant (again preferably either including or accompanied by a conventional plasticizer) is applied by element 66 which may be similar to element 46. (Element 66 can either be omitted or supplied only with plasticizer if outer member 22 is not to be flavored.) The filter structure exiting from element 62 and 66 is pulled along by conventional garniture means 72.

The filter structure exiting from garniture means 72 is pulled into another conventional garniture means 82 along with conventional plugwrap material 24. Garniture means 82 wraps plugwrap 24 around the previously formed filter structure to produce fully assembled filter structure 12. Conventional means such as an internal glue line are used to secure plugwrap 24 to outer member 22. The filter structure 12 exiting from garniture means 82 is further processed by conventional means (not shown) to produce finished cigarettes 10.

Other possible locations for flavorant-applying elements 46 and 66 are respectively indicated by arrows 46*a* and 66*a* in FIG. 2 (i.e., after rather than before garniture means 52 in the case of element 46, and after rather than before garniture means 72 in the case of element 66).

Note that no heat or steam is employed in the apparatus of FIG. 2. There is therefore nothing in this apparatus to disturb the flavorant after it has been added to either or both of members 20 and 22. In particular, if the above-mentioned PVA-flavorants are employed, there is no subsequently applied steam to cause premature activation and therefore loss of the flavorant.

Figure 3:
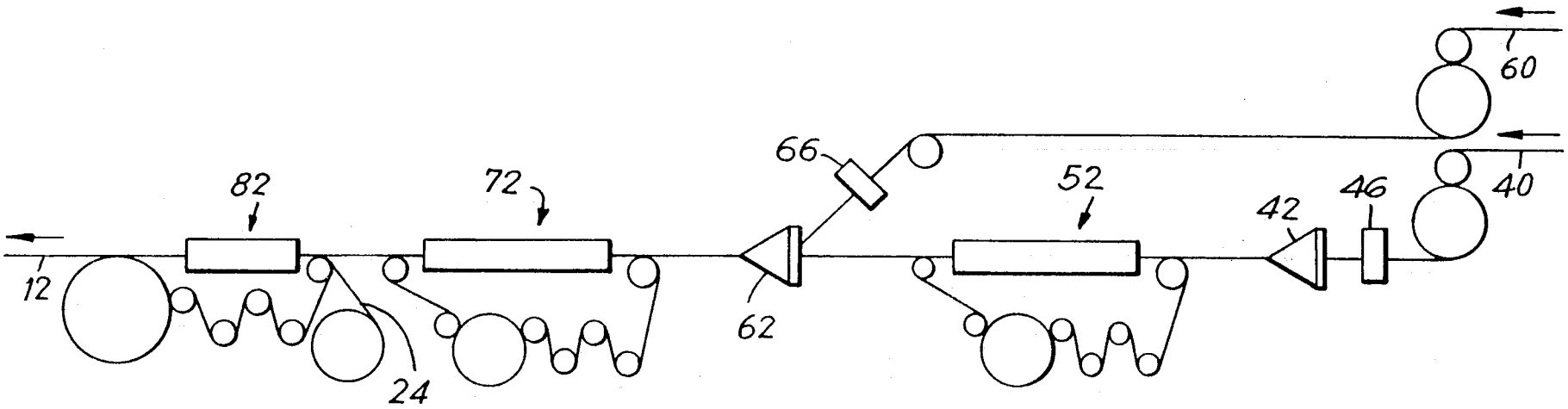
FIG. 3 is a simplified schematic diagram of alternative apparatus constructed in accordance with this invention for making filters of the type shown in FIG. 1.

An alternative embodiment of apparatus for making filter 12 is shown in FIG. 3. In FIG. 3 the flavorant is applied to tow 40 and/or tow 60 upstream of stuffer jets 42 and 62 by elements 46 and/or 66, respectively. In all other respects, the embodiment of FIG. 3 may be similar to the embodiment of FIG. 2. If desired, elements of the embodiments of FIGS. 2 and 3 can be combined, e.g., by applying one flavorant upstream of a stuffer jet, and another flavorant downstream of a stuffer jet.

Figure 4:
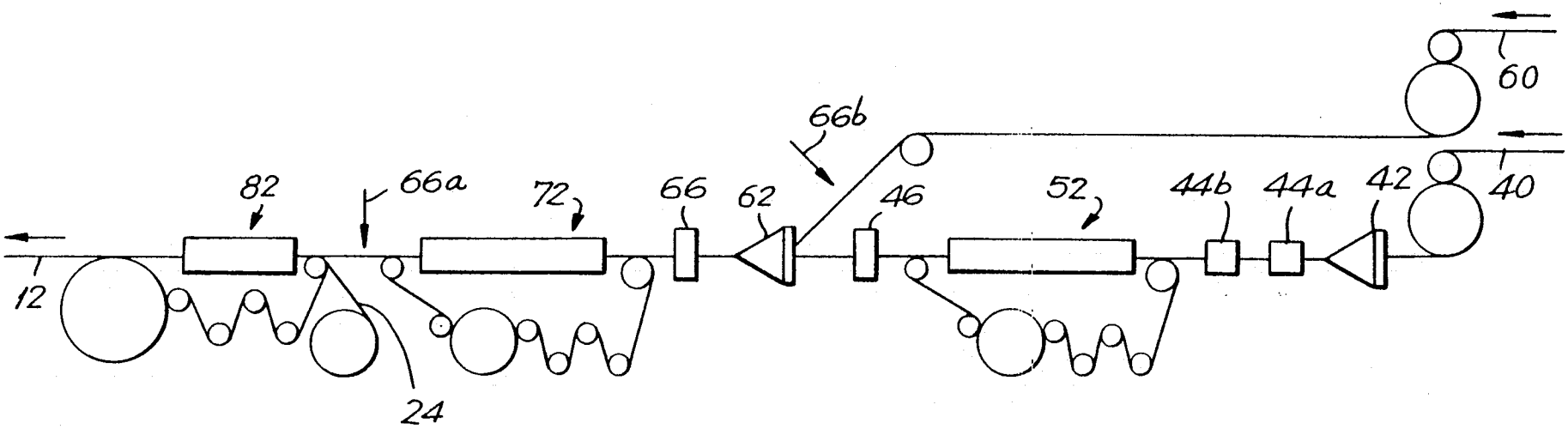
FIG. 4 is a simplified schematic diagram of another alternative apparatus constructed in accordance with this invention for making filters of the type shown in FIG. 1.

FIG. 4 shows another alternative embodiment of apparatus for making filter 12. In FIG. 4 a conventional steam head 44*a* is used to stabilize the rod of filter material exiting from stuffer jet 42, and a conventional cooling head 44b is used to cool the stabilized rod exiting from steam head 44a. At any desired point after the filter material has passed through steam head 44a, flavorant is added (e.g., by element 46 downstream from garniture means 52, and/or by element 66 downstream from stuffer jet 62. (Other possible locations for element 66 are indicated by the arrows 66a and 66b in FIG. 4.) In all other respects, the embodiment of FIG. 4 may be similar to the previously described embodiment. Note that in general, if steam is used as in the embodiment of FIG. 4, the flavorant is not added until a point or points downstream from the point or points at which the steam is used.

Figure 5:
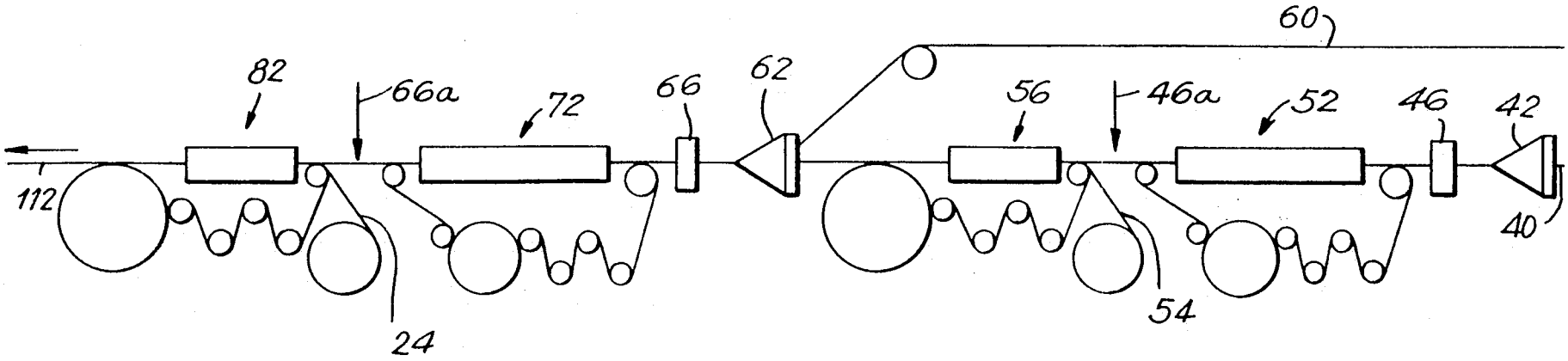
FIG. 5 is a simplified schematic diagram of apparatus constructed in accordance with this invention for making a modified form of the filter of this invention.

FIG. 5 shows yet another illustrative embodiment of the apparatus of this invention, and FIG. 6 shows a modified filter 112 produced by that apparatus. Filter 112 is similar to filter 12 except that it has an additional layer of plugwrap-type wrapping material 54 around inner member 20. If complete stabilization of inner member is needed, and it is preferred not to use other stabilizing means such as steam head 44a in FIG. 4, then wrapping material 54 can be used to stabilize inner member 20.

The apparatus of FIG. 5 is similar to the apparatus of FIG. 2, but with the addition of conventional garniture means 56 between garniture means 52 and stuffer jet 62 for applying wrapping material 54 to inner member 20.

In addition to allowing flavorant to be added to either or both of two separate regions in the filter, the present invention allows these two regions to have different flow characteristics (e.g., as a result of using different filter materials and/or as a result of using different filter material densities). For example, if the same material is used for tows 40 and 60 in any of the embodiments shown in FIGS. 2–5, but tow 40 is left relatively loose by stuffer jet 42 while tow 60 is more highly compressed by stuffer jet 62, inner member 20 will offer much less resistance to smoke flow than outer member 22. Most of the smoke will flow through inner member 20, and relatively little smoke will flow through outer member 22. If, in addition, the flavorant is added only to inner member 22, the results will be efficient use of the flavorant (with consequent savings in the amount of flavorant required) and direction of most of the smoke onto the tongue and away from the lips of the smoker. This may be especially advantageous with menthol flavor (such as is produced by activation of the abovementioned PVA-menthol flavorant) because menthol flavor is more desired on the tongue than on the lips. As mentioned above, in a particularly preferred embodiment employing the abovementioned PVA-menthol flavorant, inner member 20 has a pressure drop of about 2.0–3.0 inches of water per 27 mm of length, while outer member 22 has a pressure drop of 15 inches or more of water per 27 mm of length. In that embodiment, approximately 95% of the smoke flows through inner member 20.

Another advantage of embodiments in which inner member 20 is less resistant to smoke flow than outer member 22 may arise in the case of cigarettes in which tipping overwrap 16 admits dilution air into the filter (e.g., through conventional perforations (not shown) in overwrap 16). In that case, the dilution air tends to be drawn radially inward through outer member 22 and into inner member 20 where it mixes efficiently with the smoke.

Although the particularly preferred embodiment described above has the flavorant and lower flow resistance in inner member 20, other combinations of flavorant location and flow resistance may be employed to achieve other filter objectives. For example, the flavorant and lower flow resistance could be provided in outer member 22. Or to achieve extremely mild or subtle flavoring, the flavorant could be provided in the filter member having higher flow resistance, which could be either inner member 20 or outer member 22 depending on other filter objectives. Similarly, various combinations of flavors can be achieved by including one flavorant in inner member 20 and a different flavorant in outer member 22. The relative strength of flavors can then be adjusted, if desired, by appropriate choice of the relative flow resistance of members 20 and 22.

From the foregoing, those skilled in the art will appreciate that a wide range of filter objectives can be attained by appropriate selection of the various filter component parameters that characterize this invention. Those skilled in the art will also appreciate that the particular embodiments described above are merely illustrative of the principles of the invention, and that various modifications can be made without departing from the scope and spirit of the invention. For example, if the density (and therefore the firmness) of outer member 22 is relatively low, a relatively stiff plugwrap 24 can be used to increase the overall firmness of the filter.

We claim:

1. The method of making filters for smoking articles comprising the steps of:

supplying a first filamentary tow of filter material in a first substantially continuous axial stream;

annularly compressing the tow in said first stream to produce a substantially cylindrical first rod;

supplying a second filamentary tow of filter material in a second substantially continuous axial stream;

forming the tow in said second stream into an annulus around said first rod and annularly compressing said annulus to form a second rod in which said first rod is embedded;

adding flavorant to at least one component of said second rod;

supplying a plugwrap in a substantially continuous axial stream; and securing said plugwrap concentrically around said second rod.

2. The method defined in claim 1 wherein the tow in said first stream is compressed to a density different from the density to which the tow in said second stream is compressed so that when the smoking article in which the resulting filter is included is smoked, more of the smoke flows through the filter material of lower density than flows through the filter material of higher density.

3. The method defined in claim 2 wherein said flavorant is added to the component of said second rod that is compressed to lower density.

4. The method defined in claim 3 wherein the lower density component is the first rod.

5. The method defined in claim 2 wherein the flavorant is a PVA-flavorant.

6. The method defined in claim 4 wherein the flavorant is PVA-menthol.

7. The method of making filters for smoking articles comprising the steps of:

supplying a first filamentary tow of filter material in a first substantially continuous axial stream;

annularly compressing the tow in said first stream to produce a substantially cylindrical first rod;

supplying a second filamentary tow of filter material in a second substantially continuous axial stream;

forming the tow in said second stream into an annulus around said first rod and annularly compressing said annulus to form a second rod in which said first rod is embedded;

supplying a plugwrap in a substantially continuous axial stream;

securing said plugwrap concentrically around said second rod; and applying stream to said first rod to stabilize it prior to forming the tow in said second stream around said first rod.

8. The method of making filters for smoking articles comprising the steps of:

supplying a first filamentary tow of filter material in a first substantially continuous axial stream;

annularly compressing the tow in said first stream to produce a substantially cylindrical first rod;

supplying a second filamentary tow of filter material in a second substantially continuous axial stream;

forming the tow in said second stream into an annulus around said first rod and annularly compressing said annulus to form a second rod in which said first rod is embedded;

supplying a plugwrap in a substantially continuous axial stream;

securing said plugwrap concentrically around said second rod;

supplying a wrapping web in a substantially continuous axial stream; and adding said wrapping web to said first rod by securing said wrapping web concentrically around said first rod prior to forming the tow in said second stream around said first rod.

9. Apparatus for making filters for smoking articles comprising:

means for supplying a first filamentary tow of filter material in a first substantially continuous axial stream;

means for annularly compressing the tow in said first stream to produce a substantially cylindrical first rod;

means for supplying a second filamentary tow of filter material in a second substantially continuous axial stream;

means for forming the tow in said second stream into an annulus around said first rod and annularly compressing said annulus to form a second rod in which said first rod is embedded;

means for adding a flavorant to at least one component of said second rod;

means for supplying a plugwrap in a substantially continuous axial stream; and means for securing said plugwrap concentrically around said second rod.

10. The apparatus defined in claim 9 wherein said means for annularly compressing the tow in said first steam compresses said first stream tow to a density different from the density to which said means for forming the tow in said second stream compresses said second stream tow.

11. The apparatus defined in claim 10 wherein said means for adding flavorant adds flavorant to the component of said second rod that is compressed to lower density.

12. The apparatus defined in claim 11 wherein said means for annularly compressing the tow in said first stream compresses said first stream tow to a lower density than the density to which said means for forming the tow in said second stream compresses said second stream tow.

13. The apparatus defined in claim 10 wherein said means for adding flavorant adds a PVA-flavorant.

14. The apparatus defined in claim 12 wherein said means for adding flavorant adds PVA-menthol.

15. Apparatus for making filters for smoking articles comprising:

means for supplying a first filamentary tow of filter material in a first substantially continuous axial stream;

means for annularly compressing the tow in said first stream to produce a substantially cylindrical first rod;

means for supplying a second filamentary tow of filter material in a second substantially continuous axial stream;

means for forming the tow in said second stream into an annulus around said first rod and annularly compressing said annulus to form a second rod in which said first rod is embedded;

means for supplying a plugwrap in a substantially continuous axial stream;

means for securing said plugwrap concentrically around said second rod; and means for applying steam to said first rod to stabilize it prior to forming the tow in said second stream around said first rod.

16. Apparatus for making filters for smoking articles comprising:

means for supplying a first filamentary tow of filter material in a first substantially continuous axial stream;

means for annularly compressing the tow in said first stream to produce a substantially cylindrical first rod;

means for supplying a second filamentary tow of filter material in a second substantially continuous axial stream;

means for forming the tow in said second stream into an annulus around said first rod and annularly compressing said annulus to form a second rod in which said first rod is embedded;

means for supplying a plugwrap in a substantially continuous axial stream;

means for securing said plugwrap concentrically around said second rod;

means for supplying a wrapping web in a substantially continuous stream; and means for adding said wrapping web to said first rod by securing said wrapping web concentrically around said first rod prior to forming the tow in said second stream around said first rod.

17. A smoking article filter comprising:

a substantially cylindrical inner member of filter material having a first density;

an outer member of filter material concentrically surrounding said inner member and having a second density greater than said first density;

a plugwrap concentrically surrounding said outer member; and a PVA-flavorant associated with said inner member.

18. The filter defined in claim 17 wherein said flavorant is PVA-flavorant.

19. A smoking article filter comprising:

a substantially cylindrical inner member of filter material having a first density;

a wrapping layer concentrically surrounding said inner member;

an outer member of filter material concentrically surrounding said wrapping layer and having a second density different from said first member;

a plugwrap concentrically surrounding said outer member; and a flavorant associated with at least one of said inner and outer members.

* * * * *